United States Patent [19]

Okamura et al.

[11] Patent Number: 4,708,927

[45] Date of Patent: Nov. 24, 1987

[54] PHOTOGRAPHIC ELEMENTS WITH DEVELOPMENT INHIBITOR PRECURSOR

[75] Inventors: Hisashi Okamura; Hiroshi Kawamoto; Yoshio Sakakibara, all of Kanagawa, Japan

[73] Assignee: Fuji Photo Film Co., Ltd., Kanagawa, Japan

[21] Appl. No.: 851,052

[22] Filed: Apr. 10, 1986

[30] Foreign Application Priority Data

Apr. 11, 1985 [JP] Japan ..... 60-77302

[51] Int. Cl.[4] ..... G03C 5/54; G03C 1/40

[52] U.S. Cl. ..... 430/564; 430/219; 430/382; 430/390; 430/445; 430/544; 430/559; 430/611; 430/957; 430/960

[58] Field of Search ..... 430/382, 219, 390, 445, 430/544, 559, 960, 957, 611, 564

[56] References Cited

U.S. PATENT DOCUMENTS

| | | | |
|---|---|---|---|
| 4,472,493 | 9/1984 | Okamura et al. | 430/957 |
| 4,511,644 | 4/1985 | Okamura et al. | 430/544 X |
| 4,562,138 | 12/1985 | Uemura et al. | 430/544 X |
| 4,584,257 | 4/1986 | Okamura et al. | 430/960 X |

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A novel photographic element is disclosed. The element comprises a light-sensitive element including a light-sensitive silver halide emulsion layer coated on a support, wherein said silver halide emulsion layer or other photographic layers contain at least one development inhibitor precursor represented by formula (I)

$$A-S-CH_2CH_2-SO_2\text{-}(CH_2)_p \qquad (I)$$

$$\begin{array}{c} OH \quad\quad OH \\ | \quad\quad\quad | \\ -CH\text{-}(L-CH)_n\text{-}(CH_2)_q SO_2-CH_2CH_2-S-A \end{array}$$

wherein A represents a phenyl group or a 5- or 6-membered nitrogen-containing heterocyclic ring group; L represents a chemical bond or divalent linking group; p and q each represents an integer of 1 or 2; and n represents 0 or 1.

12 Claims, No Drawings

PHOTOGRAPHIC ELEMENTS WITH DEVELOPMENT INHIBITOR PRECURSOR

FIELD OF THE INVENTION

The present invention relates to a photographic element. More particularly, the present invention relates to a photographic element, particularly a color diffusion transfer photographic element, which contains a novel development inhibitor precursor.

BACKGROUND OF THE INVENTION

Color diffusion transfer photographic elements containing a development inhibitor or a precursor thereof are known in the art, as described, for example, in U.S. Pat. No. 3,260,597 to Weyerts et al., U.S. Pat. No. 3,265,498 to Rogers, U.S. Pat. No. 4,009,029 to Hammond et al., Japanese Patent Application (OPI) Nos. 130929/79 to Fushiya et al and 138745/80 to Uemura et al (the term "OPI" as used herein refers to a "published unexamined Japanese patent application"). Some of the compounds illustrated in these patents inhibit not only undesired development, but also necessary development, thereby deteriorating the image quality. Some other compounds do not sufficiently release a development inhibitor at an elevated temperature, and therefore cannot sufficiently inhibit an increase in the minimum density and decrease in the sensitivity. Furthermore, particularly when incorporated into a so-called neutralization timing layer in the color diffusion transfer photographic element, these compounds delay the neutralization timing. Such a delay in the neutralization timing deteriorates the sharpness and image quality of transferred color images. Thus, no compounds have heretofore been provided which completely satisfactorily inhibit the increase in the minimum density without lowering the maximum density and deteriorating the image quality of transferred color images.

In particular, the compounds disclosed in the above-described Japanese Patent Application (OPI) No. 138745/80, though containing compounds having a structure somewhat similar to that of the compound of the present invention, do not sufficiently release development inhibitor, and therefore do not sufficiently inhibit the increase in the minimum density at an elevated temperature, as is described in more detail hereinafter.

SUMMARY OF THE INVENTION

It is therefore an object of the present invention to provide a color diffusion transfer photographic element which can provide a high image quality.

It is another object of the present invention to provide a color diffusion transfer photographic element having excellent processing temperature characteristics.

It is a further object of the present invention to provide a color diffusion transfer photographic element which contains a novel development inhibitor and its precursor.

These and other objects of the present invention will become more apparent from the following detailed description and examples.

The inventors have made intensive studies to overcome the above disadvantages of the prior art. As a result, the inventors have found that the above objects of the present invention can be accomplished by a photographic element which comprises a light-sensitive element having a light-sensitive silver halide emulsion layer coated on a support, wherein said silver halide emulsion layer or other photographic layers contain a novel development inhibitor precursor of formula (I)

$$A-S-CH_2CH_2-SO_2\left(CH_2\right)_p-\underset{}{\overset{OH}{\overset{|}{C}}}H\left(L-\overset{OH}{\overset{|}{C}}H\right)_n\left(CH_2\right)_q SO_2-CH_2CH_2-S-A \quad (I)$$

wherein A represents a phenyl group or a 5- or 6-membered nitrogen-containing heterocyclic ring group (which may be substituted); L represents a chemical bond or divalent linking group; p and q each represents an integer of 1 or 2; and n represents 0 or 1.

DETAILED DESCRIPTION OF THE INVENTION

Examples of the substituent for the phenyl group represented by A in formula (I) include an alkyl group, preferably having from 1 to 4 carbon atoms, e.g., a methyl group, an ethyl group, etc., an alkoxy group, preferably having from 1 to 4 carbon atoms, e.g., a methoxy group, an ethoxy group, etc., a nitro group, a halogen atom, e.g., a chlorine atom, etc., an alkoxycarbonyl group, preferably having from 1 to 4 carbon atoms in an alkyl moiety thereof, e.g., a methoxycarbonyl group, an ethoxycarbonyl group, etc., a substituted or unsubstituted carbamoyl group (the substituent is preferably an alkyl group having from 1 to 4 carbon atoms or a phenyl group), and a sulfamoyl group (the substituent is preferably an alkyl group having from 1 to 4 carbon atoms or a phenyl group).

The nitrogen-containing heterocyclic ring represented by A in formula (I) may be a condensed ring with benzene or may be substituted with generally employed substituents such as phenyl group, etc. Examples of such a nitrogen-containing heterocyclic compounds include tetrazole rings such as tetrazole ring and phenyl tetrazole ring, triazole rings such as benzotriazole rings and 1,2,4-triazole rings, diazole rings such as benzimidazole rings and imidazole rings, pyrimidine rings such as pyrimidine rings, and monoazole rings such as benzothiazole rings and benzoxazole rings. Suitable nitrogen-containing heterocyclic compounds which can be used in the present invention include those having at least two hetero atoms, such as tetrazole rings, benzotriazole rings, and benzothiazole rings, and more preferably tetrazole rings, particularly a phenyltetrazole ring.

Preferred examples of the divalent group represented by L in formula (I) include an alkylene group having from 1 to 10 carbon atoms, an arylene group having from 6 to 10 carbon atoms, divalent groups represented by the formula $$-O-,\ -\underset{R}{\underset{|}{N}}-,\ -S-,\ -SO-,\ -SO_2-,\ \text{or}\ -\underset{O}{\underset{\|}{C}}-$$

and combinations of these divalent groups. R represents a hydrogen atom, an alkyl group having from 1 to 10 carbon atoms, an aryl group having from 6 to 10 carbon atoms, or an aralkyl group having from 7 to 10 carbon atoms. When L is not a chemical bond, these divalent groups may be further substituted. Examples of the substituent for the divalent group represented by L include an alkyl group having from 1 to 10 carbon atoms, an alkoxy group having from 1 to 10 carbon atoms, an aryl group having from 6 to 10 carbon atoms, an aryloxy group having from 6 to 10 carbon atoms, an aralkyl group having from 7 to 10 carbon atoms, an aralkyloxy group having from 7 to 10 carbon atoms, a halogen atom (e.g., a fluorine atom, a chlorine atom, a bromine atom, an iodine atom), a nitro group, a cyano group, a carbamoyl group, an alkoxycarbonyl group having from 1 to 10 carbon atoms, an acyl group having from 1 to 10 carbon atoms, an acyloxy group having from 1 to 10 carbon atoms, etc.

The development inhibitor precursor of formula (I) may be added to any layer so long as photographic layers and the development inhibitor precursor are combined so as to effectively act on the development of the silver halide emulsion. Preferably, the development inhibitor precursor is incorporated into light-sensitive elements such as a silver halide emulsion layer, a dye image donor compound-containing layer, or other auxiliary layers, image-receiving elements such as image-receiving layer and white color reflective layer, or neutralization elements such as neutralization layer and neutralization timing layer. Particularly preferably, the development inhibitor precursor is incorporated into a neutralization layer or a neutralization timing layer.

The amount of the above-described development inhibitor precursor to be added in the diffusion transfer photographic process depends on the development conditions, method of preparation of the silver halide emulsion, etc., but should generally be within the range of at least of $10^{-5}$ mol, and preferably from $10^{-4}$ to $10^{-1}$ mole per mol of silver. The development inhibitor precursor of the present invention can be dispersed into desired layers by technically effective method. In a preferred embodiment, the development inhibitor of the present invention may be contained in the form of a solution with an organic solvent such as acetone. Alternatively, the development inhibitor of the present invention may be dissolved in a high boiling solvent such as water-insoluble color former solvent, and the resulting solution may be incorporated into a carrier substance in the form of an emulsion-dispersed material. Examples of typical color former solvents include liquid dye stabilizing agents described in the article titled "Improved Photographic Dye Image Stabilizers—Solvents" in Vol. 83 of *Product Licensing Index* (published March 1971) and suitable polar solvents such as tri-o-cresyl phosphate, di-n-butyl phthalate, diethyl laurylamide, and 2,4-diaryl phenol. In another preferred embodiment, a neutralizing layer, a neutralization timing layer, or the like is provided by applying a coating having a development inhibitor precursor dissolved in an organic solvent.

Thus, there are various methods for incorporating a development inhibitor precursor into photographic layers, but the present invention is not limited to any particular method.

A preferred embodiment of the present invention is a color photographic element which comprises a light-sensitive element having at least one light-sensitive silver halide emulsion layer combined with a dye image donor compound coated on a first support, and an image-receiving element having an image-receiving layer coated on a support (which is the same as or different from said first support), and which contains a development inhibitor precursor in the above-described photographic layers of these elements, wherein said development inhibitor precursor is a compound of formula (I).

Another preferred embodiment of the present invention is a color diffusion transfer photographic element which contains at least one development inhibitor precursor represented by formula (I) in photographic layers as described above, wherein said photographic element comprises (i) a support, (ii) a light-sensitive element which contains at least one silver halide emulsion layer and a dye image donor compound combined therewith, (iii) an image-receiving element which fixes a diffusive dye produced from said dye image donor compound so as to form an image, optionally (iv) other hydrophilic colloid layers, (v) an alkali treatment composition which enables said light-sensitive element exposed to light to be developed, and (vi) a neutralizing element which neutralizes said alkali treatment composition. In this case, the image-receiving element may be provided on either the same support as or different support from that for the light-sensitive element.

A further preferred embodiment of the present invention is a color diffusion transfer photographic element which contains at least one development inhibitor precursor represented by formula (I) in photographic layers as described above, wherein said photographic element has an image-receiving layer which fixes a diffusive dye on a transparent support so that it forms an image, a white color reflective layer, a light screen layer, a light-sensitive sheet on which at least one silver halide emulsion layer combined with a dye image donor compound is laminated, an alkali treatment composition which enables silver halide that has been exposed to light to be developed, and a cover sheet having a neutralizing composition which neutralizes said alkali treatment composition, on a support different from said first support.

In particular, preferred among the compounds of formula (I) are those of the formula (II)

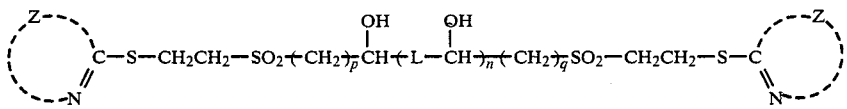

(II)

wherein Z represents a non-metallic atomic group forming a substituted or unsubstituted 5- or 6-membered nitrogen-containing heterocyclic ring group, which is preferably selected from tetrazole ring groups, more preferably 1-phenyltetrazole ring; L, p, q, and n are the same as defined in formula (I); p and q each is preferably 1; n is preferably 0.

L is preferably an alkylene having from 1 to 6 carbon atoms such as a methylene group, an ethylene group, a trimethylene group and a hexamethylene group, phenylene group, xylylene group or a group obtained by combining these groups and ether bonds.

In general, a development inhibitor precursor useful in the present invention decomposes in an alkaline solution so that it release a development inhibitor capable of being diffused therein.

Examples of typical compounds of formula (II) include those set forth below.

Compound 1
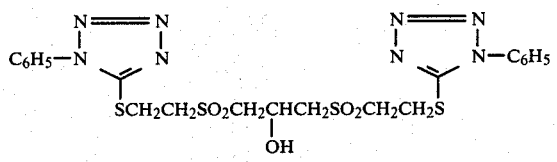
Compound 2
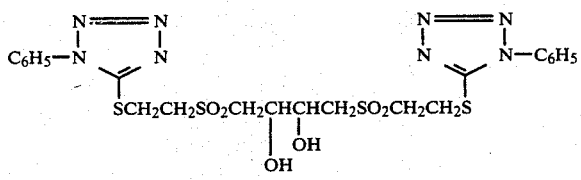
Compound 3
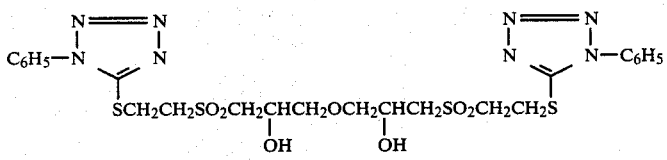
Compound 4
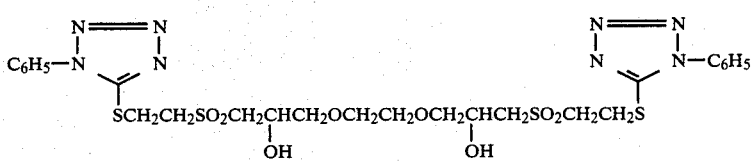
Compound 5
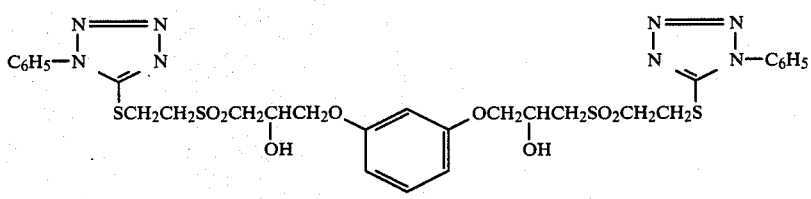
Compound 6
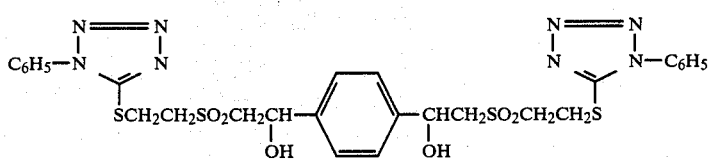
Compound 7
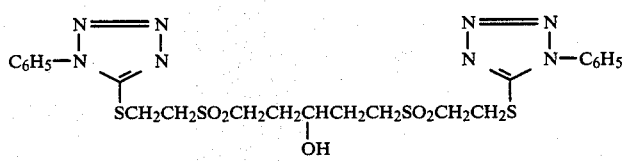
Compound 8
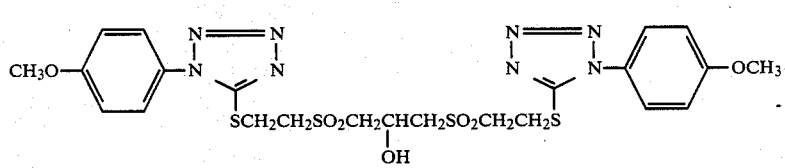

-continued

Compound 9

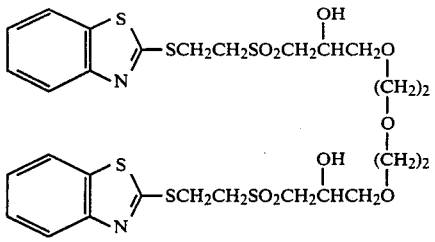

These compounds can be synthesized by addition of a thiol of formula (IV) to a compound of formula (III) having two vinylsulfonyl groups in a molecule thereof.

$$CH_2{=}CH{-}SO_2{-}(CH_2)_p{-}\overset{OH}{\overset{|}{C}}H{-}(L{-}\overset{OH}{\overset{|}{C}}H)_n{-}(CH_2)_q{-}SO_2{-}CH{=}CH_2 \quad \text{(III)}$$

$$A{-}SH \quad \text{(IV)}$$

wherein A, L, p, q, and n are the same as defined for formula (I). The compound of formula (III) having two vinylsulfonyl groups in a molecule thereof is well known as a hardener of gelatin binder in the art, and its syntheses are described in detail in Japanese Patent Publication No. 35807/75, Japanese Patent Application (OPI) Nos. 41221/78, 30022/79 and 57257/78, and U.S. Pat. No. 3,642,486. In particular, Japanese Patent Application (OPI) No. 57257/78 discloses examples of the synthesis of compounds having hydroxyl groups as shown in formula (III).

The present invention is further described by the following example of the reaction of addition of a thiol of formula (IV) to a compound of formula (III).

Synthesis of Compound 1

36 g of 1-phenyl-5-mercaptotetrazole, 15 g of sodium acetate and 200 ml of acetic acid were added to 24 g of 1,3-bis(vinylsulfonyl)-2-propanol. The admixture was stirred at a temperature of 60° C. for 3 hours. The admixture was put into 1 l of methanol, and the resulting crystals were collected by filtration. The crystals thus obtained were recrystallized from 1 l of acetone to obtain Compound 1 (yield: 30 g, m.p. 142°-144° C.). The structure of the compound was confirmed by NMR spectroscopy and IR spectroscopy.

The other compounds can be synthesized in a similar manner.

In general, when a development inhibitor precursor is incorporated into a so-called neutralizing layer in a color diffusion transfer photographic element, the neutralization timing is often delayed. Such a delay in the neutralization timing causes a deterioration in the image quality, such as sharpness. It has therefore been desired to develop a compound which does not delay the neutralization timing. The use of the compounds of the present invention results in little or no delay in the neutralization timing, thus providing transferred images of a high image quality. Such an effect would not be expected, based on the apparent similarity in structure of the present development inhibitor precursor to those described in Japanese Patent Application (OPI) No. 138745/80.

The development inhibitors of formula (I) may be used singly or in combination with other development inhibitor precursors.

As the neutralization timing layer there may be employed a timing layer which is commonly known.

Examples of useful timing layers include polymers having a low alkali permeability such as polyvinyl alcohol, cellulose acetate, and partially hydrolyzed vinyl polyacetate, polymers obtained by copolymerization of a small amount of a hydrophilic comonomer such as acrylic monomer with a hydrophobic ethylenic monomer, and polymers including lactone rings.

Examples of polymers which are particularly useful include cellulose acetate disclosed in Japanese Patent Application (OPI) Nos. 136328/79 and 130926/79, and U.S. Pat. Nos. 4,009,030 and 4,029,849, polymers obtained by copolymerization of a small amount of a hydrophilic monomer such as acrylic acid, as described in Japanese Patent Application (OPI) Nos. 145217/77, 72622/78, 78130/79, 138433/79, 138432/79 and 128335/79, and U.S. Pat. No. 4,061,496, and polymers having lactone rings as disclosed in Japanese Patent Application (OPI) No. 54341/80 and *Research Disclosure* No. 18452 (1979).

In addition, compounds described in the following literature may be used.

U.S. Pat. Nos. 3,455,686, 4,009,030, 3,785,815, and 4,123,275, Japanese Patent Application (OPI) Nos. 92022/73, 64435/74, 22935/74, 77333/76, 2431/77, and 88330/77, Japanese Patent Publication Nos. 15756/69, 12676/71 and 41214/73, West German Patent Application (OLS) Nos. 1,622,936 and 2,162,277, *Research Disclosure* No. 15162 (1976).

As acidic polymers used in the neutralizing layer, the following substances may be employed.

Preferred acidic substances are those containing acidic groups (or precursor groups which provide such acidic groups upon hydrolysis) having a pKa of 9 or less. Further preferred acidic substances are higher aliphatic acids such as oleic acid as described in U.S. Pat. No. 2,983,606, polymers of acrylic acid, methacrylic acid or maleic acid and partial esters thereof or acid anhydrides thereof as described in U.S. Pat. No. 3,362,819, copolymers of acrylic acid and ester acrylate as disclosed in French Pat. No. 2,290,699, and latex type acidic polymers as disclosed in U.S. Pat. No. 4,139,383 and *Research Disclosure* No. 16102 (1977).

In addition, acidic substances disclosed in U.S. Pat. No. 4,088,493, and Japanese Patent Application (OPI) Nos. 153739/77, 1023/78, 4540/78, 4541/78 and 4542/78 may be employed.

Specific examples of acidic polymers include copolymers of a vinyl monomer such as ethylene, vinyl acetate and vinyl methyl ether and maleic anhydride and n-butyl half esters thereof, copolymers of butyl acrylate and acrylic acid, and cellulose acetate hydrogen phthalate.

In general, the liberation of the development inhibitor from the development inhibitor precursor of the present invention can be accomplished by bringing it into contact with an alkaline medium in accordance with the present invention. An increase in the temperature can accomplish or help the decomposition.

The development inhibitor precursors of the present invention may be advantageously applied to conventional light-sensitive materials as well as to the above-described diffusion transfer photographic element. The compounds of the present invention are kept stable while being contained in a light-sensitive material, giving little or no deterioration in the photographic properties. Thus, the compounds of the present invention can provide a sufficient sensitivity when exposed to light. During development, the compounds of the present invention release a mercapto compound which acts as a fog inhibitor so that fog can be effectively prevented. The compounds of the present invention can inhibit possible fog which tends to occur in rapid development using a silver halide emulsion which provides a rapid development, a silver halide emulsion combined with a development accelerator or a coupler having a high reactivity, a developing agent having a high pH, or a high developing temperature. The precursors of the present invention are inert to a silver halide emulsion while being maintained in the precursor form, and thus change to an extremely low degree even under severe storage conditions which the light-sensitive material encounters.

When the photographic element of the present is applied to the color diffusion transfer photographic process, a film unit configuration may be employed such as a peel apart type, an integrated type described in Japanese Patent Publication Nos. 16356/71 and 33697/73, Japanese Patent Application (OPI) No. 13040/75, and British Pat. No. 1,330,524, and a non-peel apart type described in Japanese Patent Application (OPI) No. 119345/82.

The light-sensitive silver halide emulsion to be used in the present invention is a hydrophilic colloidal dispersion of silver chloride, silver bromide, silver chlorobromide, silver iodobromide, silver chloroiodobromide, or a mixture thereof. The halogen composition is selected depending on the purpose and treatment condition of the light-sensitive material. The most preferred halogen composition comprises a bromide, silver iodobromide or silver chloroiodobromide having 10 mol% or less of iodide content of 30 mol% or less of chloride content.

In the present invention a negative type emulsion for forming surface latent images or a direct reversal emulsion may be used. The latter emulsions include an internal latent image emulsion and a previously fogged direct reversal emulsion.

In the reproduction of natural color by a substractive color process, a light-sensitive material comprising at least two combinations of an emulsion having selective spectral sensitivity in a certain range of wavelength and a dye image donor compound having selective spectral absorption in the same range of wavelength is used.

The dye image donor compound to be used in the present invention can be of either negative or positive type. The dye image donor compound of the present invention initially is either mobile or immobile when treated with an alkaline treatment composition.

Negative type dye image donor compounds useful in the present invention include a coupler which reacts with oxidized color developing agent to produce or release a dye. Specific examples of such a coupler are described in U.S. Pat. No. 3,227,550 and Canadian Pat. No. 602,607.

Negative type dye image donor compounds which may be preferably used in the present invention include a dye-releasing redox compound which reacts with a developing agent or electron moving agent in an oxidized form to release a dye. Typical examples of such a redox compound include those described in Japanese Patent Application (OPI) Nos. 33826/73, 54021/79, 113624/76 and 71072/81, etc. Positive type immobile dye image donor compounds which may be used in the present invention include a compound which releases a diffusive dye without receiving an electron, i.e., being reduced, or after receiving at least one electron, i.e., being reduced. Specific examples of such a compound include those described in Japanese Patent Application (OPI) Nos. 111628/74, 63618/76, 4819/77, 69033/78, 110827/78, 110828/78, and 130927/79.

Positive type dye image donor compounds useful in the present invention which are initially mobile under an alkaline photographic treatment condition include a dye developing agent. Typical examples of such a compound include those described in Japanese Patent Publication Nos. 32130/73 and 22780/80.

The dye produced from the dye image donor compound used in the present invention may be either a completed dye or a dye precursor capable of being converted to a dye in the photographic processing step or additional processing step. The final image dye may be either metallized or not.

The polymer mordant of the present invention to be contained in the image-receiving layer can be a polymer containing secondary or tertiary amino groups, a polymer having nitrogen-containing heterocyclic portions, a polymer containing quaternary cationic groups, or the like. Such a polymer preferably has a molecular weight of 5,000 or more, and more preferably 10,000 or more.

In the procedure of processing the photographic element of the present invention, if a dye-releasing redox compound is used, any suitable silver halide developing agent may be used, provided that it can cross-oxidize the dye-releasing redox compound. Such a developing agent may be incorporated into the alkaline treatment composition or any suitable layers in the photographic element. Examples of developing agents which may be used in the present invention include hydroquinones, aminophenols, phenylenediamines, and pyrazolidones such as 1-phenyl-3-pyrazolidinone, 1-phenyl-4,4-dimethyl-3-pyrazolidinone, 1-p-tryl-4-methyl-4-oxymethyl-3-pyrazolidinone, 1-(4'-methoxyphenyl)-4-methyl-4-oxymethyl-3-pyrazolidinone, and 1-phenyl-4-methyl-4-oxymethyl-3-pyrazolidinone, as described in Japanese Patent Application (OPI) No. 16131/81.

Especially preferred among these compounds is a black-and-white developing agent having a property for eliminating the formation of stains in the image-receiving layer (particularly pyrazolidinones) rather than a color developing agent such as phenylene diamines.

If a compound other than such a dye-releasing redox compound is used, a generally employed silver halide emulsion fitted to each dye image donor compound may be used.

The treatment composition to be used in processing the photographic element of the present invention preferably contains a base such as sodium hydroxide, potassium hydroxide, sodium carbonate and sodium phosphate and has a pH of 9 or more and an alkaline strength of 11.5. Such a treatment composition may contain an antioxidant such as sodium sulfite, ascorbate, and piperidinohexosereductone, or a silver ion concentration adjustor such as potassium bromide. Alternatively, the treatment composition may contain a thickening compound such as hydroxy ethylcellulose and sodium carboxymethylcellulose.

EXAMPLE 1

The following layers (1) to (3) were successively applied to a transparent polyethylene terephthalate support to prepare a cover sheet.

(1) A layer containing 11 g/m$^2$ of a copolymer of acrylic acid and butyl acrylate in the weight proportion of 80:20 and 0.22 g/m$^2$ of 1,4-bis(2,3-epoxypropoxy)butane.

(2) A layer containing 4.3 g/m$^2$ of acetyl cellulose (which produces 36.6 g of acetyl group upon hydrolysis thereof in an amount of 100 g), 0.23 g/m$^2$ of a methanol-opened product of a copolymer of styrene and maleic anhydride in a weight proportion of 60/40 (molecular weight: about 50,000), and 2.6 meq./m$^2$ of a compound described in Table 1 as a development inhibitor.

(3) A 1 μm thick layer of a coating prepared by mixing a copolymer latex of styrene, n-butyl acrylate, acrylic acid, and N-methylol acrylamide in the weight proportion of 49.7/42.3/3/5 and a copolymer latex of methyl methacrylate, acrylic acid, and N-methylol acrylamide in the weight proportion of 93/4/3 in such a manner that the proportion of solid content of the former to the latter is 6/4, said coating containing as a coating assistant a compound of the formula $$C_8F_{17}SO_2-\underset{\underset{C_3H_7}{|}}{N}-CH_2-COOK$$

The time required for the neutralization timing for each cover sheet was measured by the following steps:

pH indicator-coated film

A pH indicator-coated film was prepared by coating a transparent polyethylene terephthalate support with the following layers:

(1) An indicator containing 0.2 g/m$^2$ of thymolphthalein and 7 g/m$^2$ gelatin.

(2) A white color reflective layer containing 20 g/m$^2$ of titanium oxide and 2 g/m$^2$ of gelatin.

(3) Same as (1).

Treatment liquid

| | |
|---|---|
| Sodium salt of carboxymethyl cellulose | 40 g |
| Potassium hydroxide | 42 g |
| Water | 918 g |

The above treatment liquid was spread between each cover sheet thus prepared and the above pH indicator-coated film while the two materials were placed opposed to each other in such a manner that the thickness of the liquid thus coated reached 80 μm. The time required for the relfection density of the high pH color (blue) of thymolphthalein to be halved by neutralization (referred to as "time required for neutralization timing") was then measured at a temperature of 25° C. The measurement was accomplished by measuring the reflection density from the pH indicator-coated film.

The results are shown in Table 1.

TABLE 1

| Cover Sheet No. | Compound | Time required for neutralization timing (min.) | Δ t (min.) |
|---|---|---|---|
| 1 | — | 5.2 | — |
| 2 | PT—S—$CH_2CH_2CN$ | 6.9 | 1.7 |
| 3 | PT—S—$CH_2$—$CH_2C(=O)CH_3$ | 5.3 | 0.1 |
| 4 | PT—S—$CH_2CH_2SO_2$— 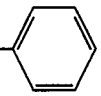 | 8.0 | 2.8 |
| 5 | PT—S—$CH_2CH_2SO_2(CH_2)_3SO_2CH_2CH_2$—S—PT | 8.2 | 3.0 |
| 6 | Compound 1 | 5.3 | 0.1 |

In Table 1, PT represents

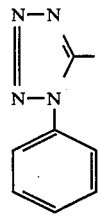

The compound was in Cover Sheet No. 2 is described in U.S. Pat. No. 4,009,029. The compound used in Cover Sheet No. 3 is described in U.S. Pat. No. 3,260,597. The compounds used in Cover Sheet Nos. 4 and 5 are described in Japanese Patent Application (OPI) No. 138745/80. These compounds were used as controls.

Δt (min.) represents the difference in the time required for neutralization timing between the case in which no development inhibitor precursor is contained (Cover Sheet No. 1) and when a compound is contained.

Table 1 shows that the compounds of the present invention provide no delay in the time required for neutralization timing (Δt) as compared to the Comparative Examples 2, 4 and 5.

EXAMPLE 2

Light-sensitive sheets were prepared by coating a transparent polyethylene terephthalate support with the following layers:

(1) A mordant layer containing 3.0 g/m$^2$ of gelatin and 3.0 g/m$^2$ of the following polymer latex mordants:

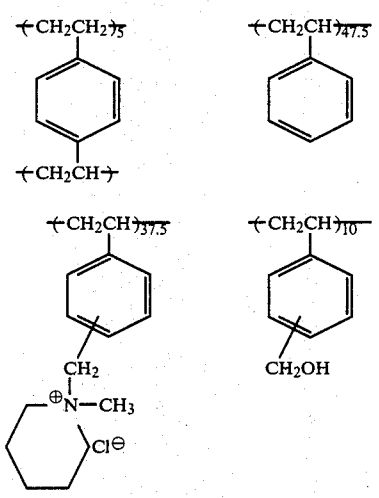

(2) A white color reflective layer containing 20 g/m$^2$ of titanium dioxide and 2.0 g/m$^2$ of gelatin.

(3) A light screen layer containing 2.0 g/m$^2$ of carbon black and 1.0 g/m$^2$ of gelatin.

(4) A layer containing 0.44 g/m$^2$ of a cyan dye-releasing redox compound of the formula described below, 0.09 g/m$^2$ of tricyclohexylphosphate, 0.008 g/m$^2$ of 2,5-di-t-pentadecylhydroquinone, and 0.8 g/m$^2$ of gelatin.

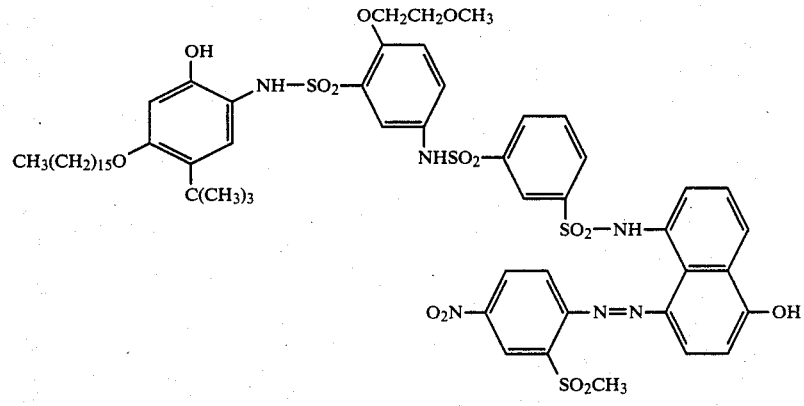

(5) A red-sensitive emulsion layer containing a red-sensitive internal latent image type direct positive silver bromide emulsion in an amount of 1.03 g/m$^2$ in terms of silver content, 1.2 g/m$^2$ of gelatin, 0.04 mg/m$^2$ of a nucleus forming agent of the formula shown below, and 0.13 g/m$^2$ of sodium salt of 2-sulfo-5-n-pentadecylhydroquinone.

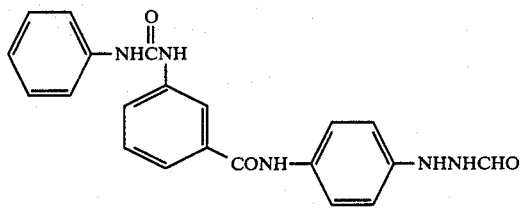

(6) A layer containing 0.43 g/m$^2$ of 2,5-di-t-pentadecylhydroquinone, 0.1 g/m$^2$ of trihexylphosphate and 0.4 g/m$^2$ of gelatin.

(7) A layer containing 0.21 g/m$^2$ of a magenta dye-releasing redox compound of the structural formula A, 0.11 g/m$^2$ of a magenta dye-releasing redox compound of the structural formula B, 0.08 g/m$^2$ of tricyclohexylphosphate, 0.009 g/m$^2$ of 2,5-di-t-pentadecylhydroquinone and 0.9 g/m$^2$ of gelatin.

Structural formula A

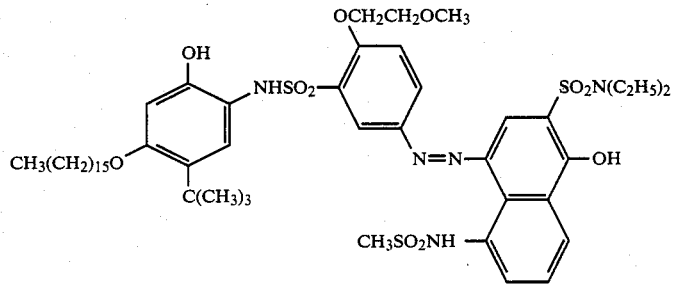

-continued

Structural formula B

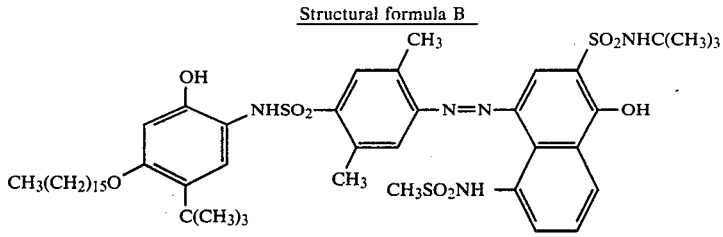

(8) A green-sensitive emulsion layer containing a green-sensitive internal latent image type direct positive silver bromide emulsion in an amount of 0.82 g/m$^2$ in terms of silver content, 0.9 g/m$^2$ of gelatin, 0.03 mg/m$^2$ of the same nucleus forming agent as used in the layer (5), and 0.08 g/m$^2$ of sodium salt of 2-sulfo-5-n-pentadecylhydroquinone.

(9) Same as (6).

(10) A layer containing 0.53 g/m$^2$ of a yellow dye-releasing redox compound of the formula shown below, 0.13 g/m$^2$ of tricyclohexylphosphate, 0.014 g/m$^2$ of 2,5-di-t-pentadecylhydroquinone and 0.7 g/m$^2$ of gelatin.

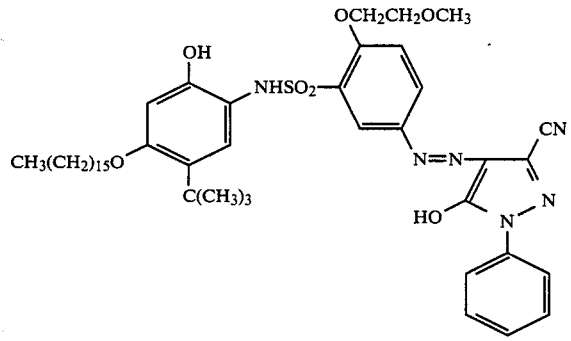

(11) A blue-sensitive emulsion layer containing a blue-sensitive internal latent image type direct positive silver bromide emulsion in an amount of 1.09 g/m$^2$ in terms of silver content, 1.1 g/m$^2$ of gelatin, 0.04 mg/m$^2$ of the same nucleus forming agent as used in the layer (5), and 0.07 g/m$^2$ of sodium salt of 2-sulfo-5-n-pentadecylhydroquinone.

(12) A layer containing 1.0 g/m$^2$ of gelatin.

The above light-sensitive sheets were exposed to light rays through a sharpness evaluation fine line test chart. The treatment liquid described below was spread over between these light-sensitive sheets and the cover sheets prepared in Example 1 while the two sheets were placed opposed to each other in such a manner that the thickness of the liquid thus spread reached 85 μm. The spreading was conducted at a temperature of 25° C. After being allowed to stand for 1 day, these specimens were measured for sharpness. The measurement was effected by means of microdensitometer with a green filter. The value of the spatial frequency were C.T.F. is 0.5 was shown in Table 2.

| Treatment liquid | |
|---|---|
| 1-p-tryl-4-hydroxymethyl-4-methyl-3-pyrazolidone | 6.9 g |
| Methylhydroquinone | 0.3 g |
| 5-methylbenzotriazole | 3.5 g |
| Sodium sulfite anhydride | 0.2 g |

-continued

| Treatment liquid | |
|---|---|
| Sodium salt of carboxymethyl cellulose | 58 g |
| 28% aqueous solution of potassium hydroxide | 200 cc |
| Benzyl alcohol | 1.5 cc |
| Carbon black | 150 g |
| Water | 685 cc |

TABLE 2

| Cover Sheet No. | Spatial frequency where C.T.F. = 0.5 |
|---|---|
| 1 (Black) | 2.9 |
| 2 (Comparative Example) | 2.2 |
| 3 (Comparative Example) | 2.8 |
| 4 (Comparative Example) | 2.3 |
| 5 (Comparative Example) | 2.2 |
| 6 (Present Invention) | 2.8 |

Table 2 shows that compounds of the present invention provide transferred images of an excellent sharpness and a high picture quality as compared to Comparative Examples 2, 4, and 5.

EXAMPLE 3

The light-sensitive sheets prepared in Example 2 were exposed to light rays through a color test chart. The treatment liquid prepared in Example 2 was spread over between these light-sensitive sheets thus exposed to light and the cover sheets prepared in Example 1 while the two sheets were placed opposed to each other in such a manner that the thickness of the liquid thus spread reached 85 μm.

The spreading was effected by means of a pressure roller at a temperature of 35° C.

TABLE 3

| Cover | Maximum density | | | Minimum density | | |
|---|---|---|---|---|---|---|
| Sheet No. | B | G | R | B | G | R |
| 1 (Black) | 2.01 | 2.28 | 2.26 | 0.32 | 0.29 | 0.46 |
| 2 (Comparative Example) | 2.03 | 2.32 | 2.29 | 0.24 | 0.23 | 0.36 |
| 3 (Comparative Example) | 1.68 | 2.20 | 2.31 | 0.23 | 0.22 | 0.35 |
| 4 (Comparative Example) | 2.03 | 2.33 | 2.30 | 0.23 | 0.22 | 0.35 |
| 5 (Comparative Example) | 1.99 | 2.31 | 2.31 | 0.25 | 0.23 | 0.38 |
| 6 (Present Invention) | 1.96 | 2.25 | 2.31 | 0.23 | 0.21 | 0.35 |

Table 3 shows the maximum density and the minimum density. It is apparent from the table that the compounds of the present invention cause little or no decrease in the maximum density, but can lower the minimum density sufficiently.

In particular, the compound used in the Cover Sheet No. 5, though having a structure similar to that of the present compounds, releases a development inhibitor slowly and thus causes a big increase in the minimum density. Thus, it is clear that the compounds of the present invention having hydroxyl groups therein are advantageous.

On the other hand, the Cover Sheet No. 3, which causes no delay in the time required for neutralization timing, is disadvantageous in that it releases a development inhibitor too fast, and thus causes a big decrease in the maximum density.

As is apparent from results of Tables 2 and 3, compounds of the present invention provide a high image quality, and further inhibit the increase in the minimum density without lowering the maximum density.

While the invention has been described in detail and with reference to specific embodiments thereof, it will be apparent to one skilled in the art that various changes and modifications can be made therein without departing from the spirit and scope thereof.

What is claimed is:

1. A photographic element which comprises a light-sensitive element including a light-sensitive silver halide emulsion layer coated on a support, wherein said silver halide emulsion layer or other photographic layers contain at least one development inhibitor precursor represented by formula (I)

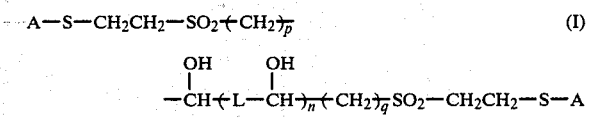

(I)

wherein A represents a phenyl group or a 5- or 6-membered nitrogen-containing heterocyclic ring group; L represents a chemical bond or divalent linking group; p and q each represents an integer of 1 or 2; and n represents 0 or 1.

2. A photographic element as in claim 1, wherein A represents a phenyl group including a substituent selected from the group consisting of an alkyl group, an alkoxy group, a nitro group, a halogen atom, an alkoxycarbonyl group, a substituted or unsubstituted carbamoyl group, and a substituted or unsubstituted sulfamoyl group.

3. A photographic element as in claim 1, wherein said nitrogen-containing heterocyclic ring group represented by A is selected from the group consisting of tetrazole rings, triazole rings, diazole rings, pyrimidine rings, and monoazole rings.

4. A photographic element as in claim 1, wherein the divalent group represented by L is selected from the group consisting of an alkylene group having from 1 to 10 carbon atoms, an arylene group having from 6 to 10 carbon atoms,

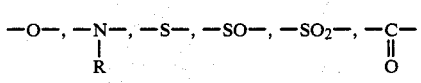

and combinations thereof, wherein R represents a hydrogen atom, an alkyl group having from 1 to 10 carbon atoms, an aryl group having from 6 to 10 carbon atoms, or an aralkyl group having from 7 to 10 carbon atoms.

5. A photographic element as in claim 1, wherein said development inhibitor precursor is represented by formula

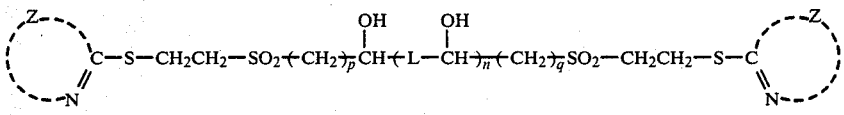

(II)

wherein Z represents a nonmetallic atomic group forming a substituted or unsubstituted 5- or 6-membered nitrogen-containing heterocyclic ring group, and L, p, q, and n are the same as defined in claim 1.

6. A photographic element as in claim 5, wherein Z represents a tetrazole ring group, p and q each represents 1, and n represents 0.

7. A photographic element as in claim 1, wherein the amount of development inhibitor precursor represented by formula (I) is from $10^{-4}$ to $10^{-1}$ mol per mol of silver in said silver halide emulsion layer.

8. A photographic element as in claim 5, wherein the amount of development inhibitor precursor represented by formula (II) is from $10^{-4}$ to $10^{-1}$ mol per mol of silver in said silver halide emulsion layer.

9. A photographic element as in claim 6, wherein the amount of development inhibitor precursor represented by formula (II) is from $10^{-4}$ to $10^{-1}$ mol per mol of silver in said silver halide emulsion layer.

10. A photographic element as in claim 1, wherein the photographic element comprises a light-sensitive element having at lease one light-sensitive silver halide emulsion layer combined with a dye image donor compound coated on a first support, and an image-receiving element having an image-receiving layer coated on a support which is the same as or different from said first support.

11. A photographic element as in claim 1, comprising a color diffusion transfer photographic element which contains at lease one development inhibitor precursor represented by formula (I), wherein said photographic element comrises (i) a support, (ii) a light-sensitive element which contains at least one silver halide emulsion layer and a dye image donor compound combined therewith, (iii) an image-receiving element which fixes a diffusive dye produced from said dye image donor compound so as to form an image.

12. A photographic element as in claim 1, comprising a color diffusion transfer photographic element which contains at least one development inhibitor precursor represented by formula (I), wherein said photographic element has an image-receiving layer which fixes a diffusive dye on a transparent support so that it forms an image, a white color reflective layer, a light screen layer, a light-sensitive sheet on which at least one silver halide emulsion layer combined with a dye image donor compound is laminated, an alkali treatment composition which enables silver halide that has been exposed to light to be developed, and a cover sheet having a neutralizing composition which neutralizes said alkali treatment composition, on a support different from said first support.

* * * * *